US006357616B1

(12) United States Patent
Harris et al.

(10) Patent No.: US 6,357,616 B1
(45) Date of Patent: Mar. 19, 2002

(54) ATTACHABLE HOLDER FOR EXERCISE DEVICES

(76) Inventors: Terry Loren Harris; Patrizia Harris, both of 42454 Plains Dr., Quartz Hill, CA (US) 93536

( * ) Notice: Subject to any disclaimer, the term of this patent is extended or adjusted under 35 U.S.C. 154(b) by 0 days.

(21) Appl. No.: 09/566,142

(22) Filed: May 5, 2000

(51) Int. Cl.[7] ..... B65D 25/22

(52) U.S. Cl. ..... 220/475; 220/737; 220/23.8; 220/555

(58) Field of Search ..... 220/475, 23.8, 220/23.83, 23.86, 555, 625, 630, 729, 737, 771

(56) References Cited

U.S. PATENT DOCUMENTS 3,948,265 A 4/1976 Al Ani ..... 128/267
4,334,642 A * 6/1982 Reisch ..... 220/475
4,747,842 A 5/1988 Dietz ..... 604/309
5,423,509 A * 6/1995 LaPorte et al. ..... 224/420
5,676,643 A 10/1997 Cann et al. ..... 604/1
5,934,499 A * 8/1999 van der Hoven ..... 220/475
6,186,383 B1 * 2/2001 Kobdish ..... 224/420
6,206,258 B1 * 3/2001 Calder ..... 224/420

* cited by examiner

*Primary Examiner*—Stephen Castellano
(74) *Attorney, Agent, or Firm*—Goldstein Law Offices, P.C.

(57) ABSTRACT

An attachable holder for exercise devices including a housing having an open upper end a closed lower end. The closed lower end has an elongated recess formed therein. The elongated recess is dimensioned for receiving the horizontal support bar of the piece of equipment therein. The closed lower end has a cover member hingedly coupled thereto. The cover member has a closed orientation containing the horizontal support bar within the elongated recess.

6 Claims, 2 Drawing Sheets

FIG. 2
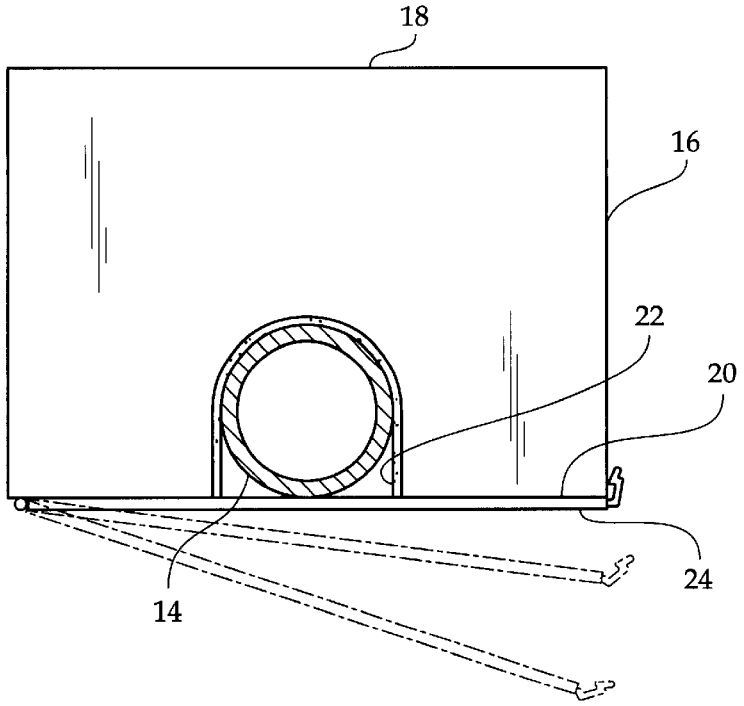
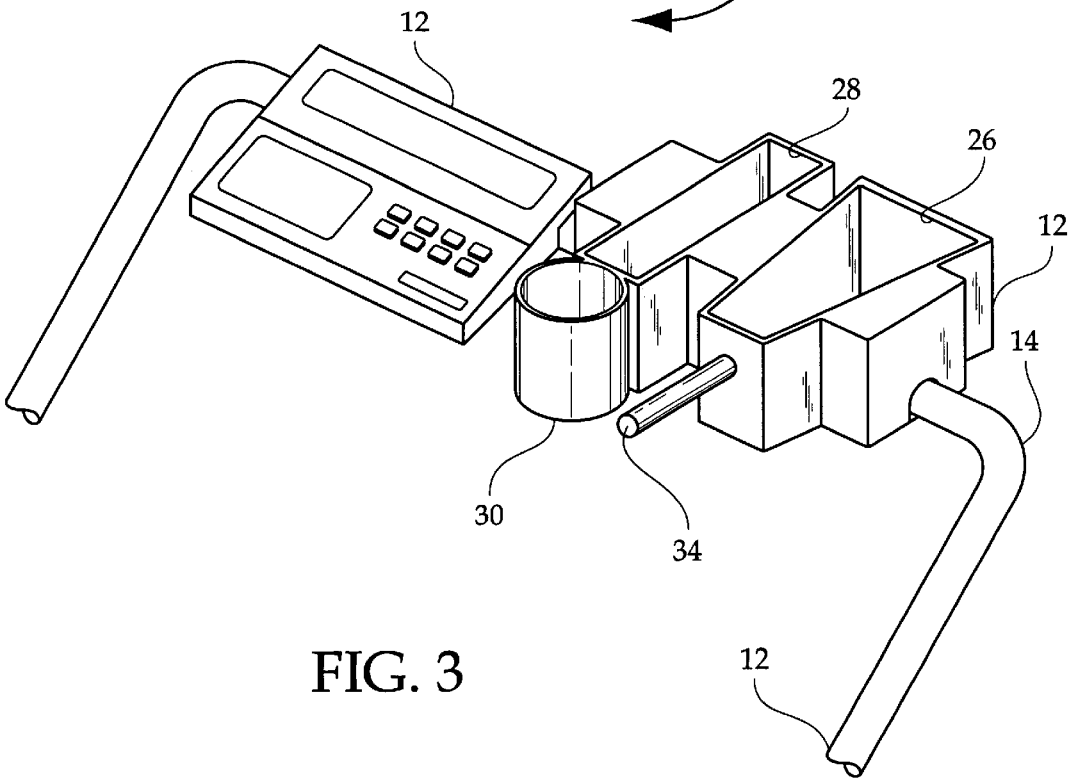
FIG. 3

ATTACHABLE HOLDER FOR EXERCISE DEVICES

BACKGROUND OF THE INVENTION

The present invention relates to an attachable holder for exercise devices and more particularly pertains to allowing various accessories to be attached to a piece of exercise equipment.

The use of sports accessories is known in the prior art. More specifically, sports accessories heretofore devised and utilized for the purpose of assisting an exercising individual are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,676,285 to Vinarsky discloses a hanger clip for attaching a bottle to a piece of exercise equipment. U.S. Pat. No. 5,697,870 to Osborn discloses a storage compartment for a piece of step-type exercise equipment.

While these devices fulfill their respective, particular objective and requirements, the aforementioned patents do not describe an attachable holder for exercise devices for allowing various accessories to be attached to a piece of exercise equipment.

In this respect, the attachable holder for exercise devices according to the present invention substantially departs from the conventional concepts and designs of the prior art, and in doing so provides an apparatus primarily developed for the purpose of allowing various accessories to be attached to a piece of exercise equipment.

Therefore, it can be appreciated that there exists a continuing need for a new and improved attachable holder for exercise devices which can be used for allowing various accessories to be attached to a piece of exercise equipment. In this regard, the present invention substantially fulfills this need.

SUMMARY OF THE INVENTION

In the view of the foregoing disadvantages inherent in the known types of sports accessories now present in the prior art, the present invention provides an improved attachable holder for exercise devices. As such, the general purpose of the present invention, which will be described subsequently in greater detail, is to provide a new and improved attachable holder for exercise devices which has all the advantages of the prior art and none of the disadvantages.

To attain this, the present invention essentially comprises a housing having an open upper end and a closed lower end. The closed lower end has an elongated recess formed therein. The elongated recess is dimensioned for receiving the horizontal support bar of the piece of exercise equipment therein. The closed lower end has a cover member hingedly coupled thereto. The cover member has a closed orientation containing the horizontal support bar within the elongated recess. The housing includes a first compartment. The first compartment has a generally trapezoidal configuration. The first compartment is dimensioned for holding selected personal belongings therein. The housing includes a second compartment. The second compartment has a generally rectangular configuration. The second compartment is dimensioned for containing a pair of eyeglasses therein. A cylindrical cup holder is secured to the second compartment of the housing. The cylindrical cup holder is dimensioned for receiving a beverage container therein. A cylindrical rod extends outwardly from the first compartment of the housing. The cylindrical rod acts as a support for a towel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved attachable holder for exercise devices which has all the advantages of the prior art sports accessories and none of the disadvantages.

It is another object of the present invention to provide a new and improved attachable holder for exercise devices which may be easily and efficiently manufactured and marketed.

It is a further object of the present invention to provide a new and improved attachable holder for exercise devices which is of durable and reliable construction.

An even further object of the present invention is to provide a new and improved attachable holder for exercise devices which is susceptible of a low cost of manufacture with regard to both materials and labor, and which accordingly is then susceptible of low prices of sale to the consuming public, thereby making such an attachable holder for exercise devices economically available to the buying public.

Even still another object of the present invention is to provide a new and improved attachable holder for exercise devices for allowing various accessories to be attached to a piece of exercise equipment.

Lastly, it is an object of the present invention to provide a new and improved attachable holder for exercise devices including a housing having an open upper end and a closed lower end. The closed lower end has an elongated recess formed therein. The elongated recess is dimensioned for receiving the horizontal support bar of the piece of exercise equipment therein. The closed lower end has a cover member hingedly coupled thereto. The cover member has a closed orientation containing the horizontal support bar within the elongated recess.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a side view of the present invention illustrated in use.

FIG. 3 is a perspective view of the present invention illustrated in use.

The same reference numerals refer to the same parts through the various figures.

DESCRIPTION OF THE PREFERRED EMBODIMENT

Figure 1:
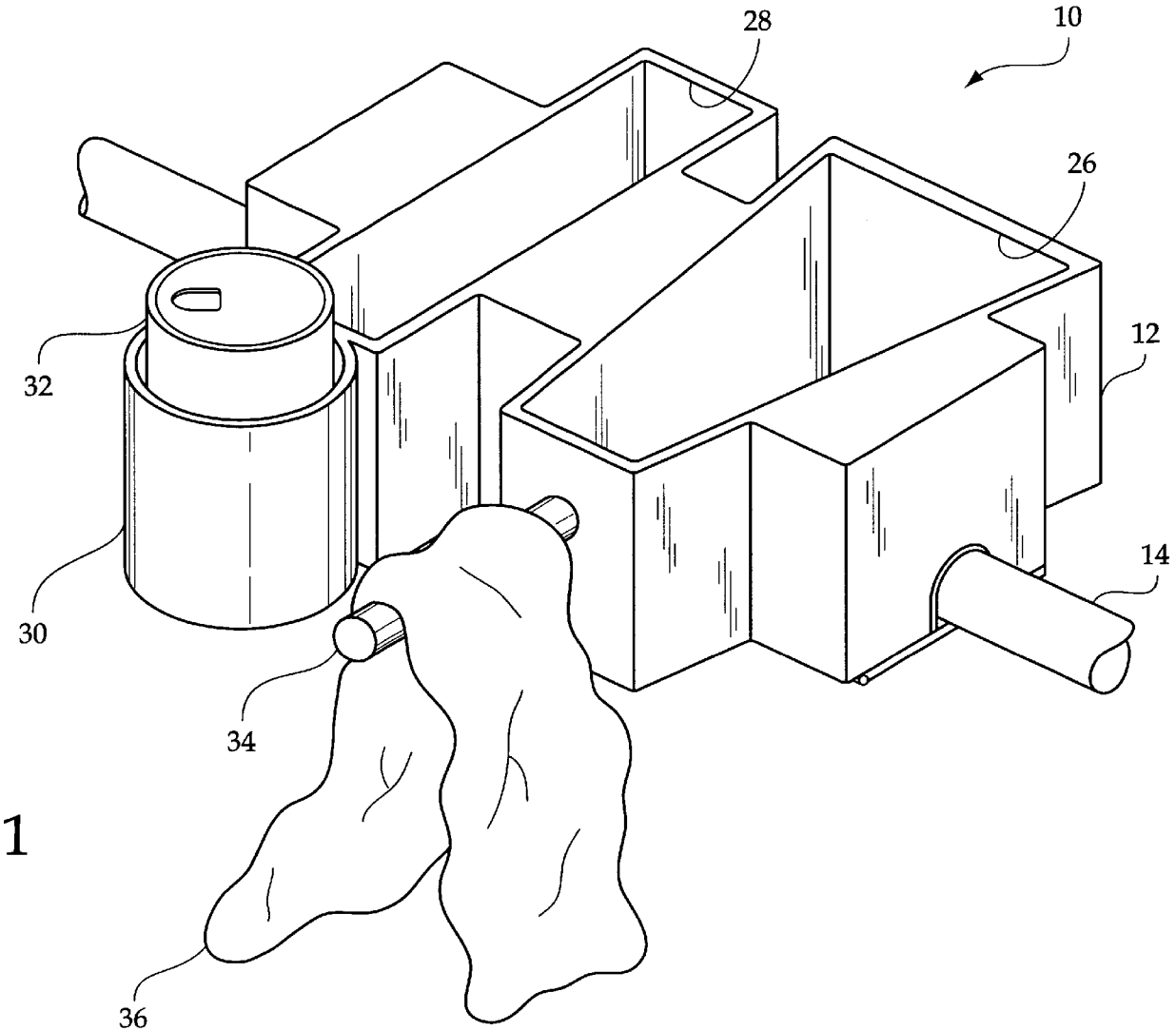
FIG. 1 is a perspective view of the preferred embodiment of the attachable holder for exercise devices constructed in accordance with the principles of the present invention.

With reference now to the drawings, and in particular, to FIGS. 1 through 3 thereof, the preferred embodiment of the new and improved attachable holder for exercise devices embodying the principles and concepts of the present invention and generally designated by the reference number 10 will be described.

Specifically, it will be noted in the various Figures that the device relates to an attachable holder for exercise devices for allowing various accessories to be attached to a piece of exercise equipment. In its broadest context, the device consists of a housing, a cylindrical cup holder, and a cylindrical rod. Such components are individually configured and correlated with respect to each other so as to attain the desired objective.

The present invention is specifically designed for coupling with a piece of exercise equipment 12. The piece of exercise equipment 12 will include a horizontal support bar 14. Note FIGS. 1 and 3. The present invention will keep all of the user's personal belongings in front of them as they use the piece of exercise equipment 12.

The housing 16 has an open upper end 18 and a closed lower end 20. The closed lower end 20 has an elongated recess 22 formed therein. The elongated recess 22 is dimensioned for receiving the horizontal support bar 14 of the piece of exercise equipment 12 therein. The closed lower end 20 has a cover member 24 hingedly coupled thereto. The cover member 24 has a closed orientation containing the horizontal support bar 14 within the elongated recess 22. Note FIG. 2. Securement to the horizontal support bar 14 is facilitated by opening the cover member 24 to expose the elongated recess 22. The housing 16 is then placed on the piece of equipment with the recess 22 receiving the horizontal support bar 14. The cover member 24 is then closed to secure the housing 16 to the piece of exercise equipment 12. Note FIGS. 1–3. The housing 16 includes a first compartment 26. The first compartment 26 has a generally trapezoidal configuration. The first compartment 26 is dimensioned for holding selected personal belongings therein. Such personal belongings typically include keys, cellular telephones, and pagers. The housing 16 includes a second compartment 28. The second compartment 28 has a generally rectangular configuration. The second compartment 28 is dimensioned for containing a pair of eyeglasses therein.

The cylindrical cup holder 30 is secured to the second compartment 28 of the housing 16. The cylindrical cup holder 30 is dimensioned for receiving a beverage container 32 therein. Note FIG. 1.

The cylindrical rod 34 extends outwardly from the first compartment 26 of the housing 16. The cylindrical rod 34 acts as a support for a towel 36. Note FIG. 1.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An attachable holder for exercise devices for allowing various accessories to be attached to a piece of exercise equipment, wherein the piece of exercise equipment has a horizontal support bar, the attachable holder comprising, in combination:

a housing having an open upper end and a closed lower end, the closed lower end having an elongated recess formed therein, the elongated recess being dimensioned for receiving the horizontal support bar of the piece of exercise equipment therein, the closed lower end having a cover member hingedly coupled thereto, the cover member having a closed orientation containing the horizontal support bar within the elongated recess.

2. The attachable holder for exercise devices as set forth in claim 1 and further including a cylindrical cup holder secured to the housing, the cylindrical cup holder being dimensioned for receiving a beverage container therein.

3. The attachable holder for exercise devices as set forth in claim 1 and further including a cylindrical rod extending outwardly from the housing, the cylindrical rod acting as a support for a towel.

4. The attachable holder for exercise devices as set forth in claim 1 wherein the housing includes a first compartment, the first compartment having a generally trapezoidal configuration, the first compartment being dimensioned for holding selected personal belongings therein.

5. The attachable holder for exercise devices as set forth in claim 1 wherein the housing includes a second compartment, the second compartment having a generally rectangular configuration, the second compartment being dimensioned for containing a pair of eyeglasses therein.

6. An attachable holder for exercise devices for allowing various accessories to be attached to a piece of exercise equipment, wherein the piece of exercise equipment has a horizontal support bar, the attachable holder comprising, in combination:

a housing having an open upper end and a closed lower end, the closed lower end having an elongated recess formed therein, the elongated recess being dimensioned for receiving the horizontal support bar of the piece of exercise equipment therein, the closed lower end having a cover member hingedly coupled thereto, the cover member having a closed orientation containing the horizontal support bar within the elongated recess, the housing including a first compartment, the first compartment having a generally trapezoidal configuration, the first compartment being dimensioned for holding selected personal belongings therein, the housing including a second compartment, the second compartment having a generally rectangular configuration, the second compartment being dimensioned for containing a pair of eyeglasses therein;

a cylindrical cup holder secured to the second compartment of the housing, the cylindrical cup holder being dimensioned for receiving a beverage container therein;

a cylindrical rod extending outwardly from the first compartment of the housing, the cylindrical rod acting as a support for a towel.

* * * * *